US005228325A

United States Patent [19]

Wiebe et al.

[11] Patent Number: 5,228,325

[45] Date of Patent: Jul. 20, 1993

[54] PLIERS WITH ROTATABLE, PIVOTABLE DIE FOR MULTI-DIRECTIONAL HANDLING OF WORKPIECE

[75] Inventors: Ulrich Wiebe, Dörentrup, Fed. Rep. of Germany; Hans Undin, Åkersberga, Sweden; Gerd Weber, Detmold, Fed. Rep. of Germany

[73] Assignee: C. A. Weidmuller Interface GmbH & Co., Fed. Rep. of Germany

[21] Appl. No.: 874,707

[22] Filed: Apr. 28, 1992

[30] Foreign Application Priority Data

May 27, 1991 [DE] Fed. Rep. of Germany ..... 4117305

[51] Int. Cl.[5] ..... H01R 43/042

[52] U.S. Cl. ..... 72/410; 72/446; 29/751

[58] Field of Search ..... 72/410, 409, 414–416, 72/453.16, 446, 456, 473, 413; 29/751; 81/421, 422, 424, 424.5, 426, 426.5; 403/93; 30/364

[56] References Cited

U.S. PATENT DOCUMENTS

| | | | |
|---|---|---|---|
| 401,003 | 4/1889 | Burns | 403/93 |
| 1,142,797 | 6/1915 | Burrell | 72/409 |
| 1,380,516 | 7/1919 | Weinstein | 72/410 |
| 1,450,198 | 4/1923 | Bailey | 72/446 |
| 2,352,917 | 7/1944 | Scott | 81/421 |
| 2,477,727 | 8/1949 | Engberg | 72/473 |
| 2,501,581 | 3/1950 | Rieger | 403/93 |
| 3,260,098 | 7/1966 | Gill | 72/416 |
| 3,470,728 | 10/1969 | Polidori | 72/410 |
| 4,537,099 | 8/1985 | Oster | 81/422 |
| 4,942,757 | 7/1990 | Pecora | 72/453.16 |

FOREIGN PATENT DOCUMENTS

| | | |
|---|---|---|
| 2928117 | 1/1981 | Fed. Rep. of Germany . |
| 3738892 | 6/1989 | Fed. Rep. of Germany . |
| 0652637 | 3/1981 | Switzerland . |

OTHER PUBLICATIONS

REMA Lipprandt GmbH & Co KG–Hydraulische und mechanische Handzangen–REMA PreB–Technik–1989.

*Primary Examiner*—Daniel C. Crane

*Attorney, Agent, or Firm*—Cushman, Darby & Cushman

[57] ABSTRACT

Pliers having a pair of handles and a pair of shank members have one member of a die pair for treating a workpiece on each of the shank members. The die members are attached to the inner sides of the shank members rotatably about an axis situated in the tool plane, and a follower is provided to ensure their corotation. The workpiece may be introduced into the die pair frontally or laterally, depending on the rotational position of the die pair. In one embodiment, the die members are also pivotable about axes extending at right angles to the tool plane. The pliers may be used in many applications such as crimping electrical terminals.

16 Claims, 3 Drawing Sheets

PLIERS WITH ROTATABLE, PIVOTABLE DIE FOR MULTI-DIRECTIONAL HANDLING OF WORKPIECE

FIELD OF THE INVENTION

The present invention refers to pliers for treating work pieces in a pair of dies, and in particular to pliers for crimping contact elements such as terminal connectors or the like on the ends of electrical conductors.

Pliers of this kind exist for frontal as well, as for lateral insertion of the work piece in the die pair. By frontal insertion is understood insertion, from the front end of the tool, in a direction parallel to, or co-inciding with the longitudinal extension of the tool body and/or the handles, i.e., along the tool plane. By "tool plane" is understood the plane in which the handles lie and move, and in which also the die movement takes place.

By lateral insertion is understood insertion in a direction at right angles to the said longitudinal extension, e.g., at right angles to the tool plane.

Experience has proven that approximately one half of the users prefer the first mentioned manner of insertion, and the other half prefer the last mentioned manner of insertion, or that in approximately one half of all applications call for use of the one manner, and in the other half the other manner is preferred.

In another aspect, pliers may be divided into a category of "scissors-like", where the carriers of the dies or jaws perform a scissors-like pivotal movement, and a category of "vice-like", where said members perform a parallel movement. The present invention is applicable to both of said types.

BACKGROUND OF THE INVENTION

In the published German patent application Ser. No. 2,928,117 are described pliers of the scissors type which comprise a pair of hinged-together members having a rear handle portion and a front shank portion, and a pair of hinged-together flat, elongated working jaws, each with a rearward extension beyond the hinge point. The pair of jaws is with one of the rearward extensions mounted on the outer side of one of the shank portions so as to be rotatable about an axis lying in the tool plane, so that the whole pair of jaws may be swung out of the tool plane.

For transferring the movement of the other shank portion to the other jaw, a driving rod is slidably mounted between these two members, passing through holes in the other jaw extension and in the other shank portion.

The purpose of the rotatable mounting of the pair of jaws is, however, not to enable the option between frontal and lateral introduction of the work piece, but to enable adjustment of the angle between the tool plane and the jaws.

A pair of jaws mounted on the outside of one of the shank portions embodies a structure which considerably protrudes beyond the outline of a conventional pair of pliers, i.e., occupies additional space. The jaws, particularly when swung out of the tool plane, cannot affect the work piece with as high a thrust as when the work piece is located between two shank members. High thrust is however needed on occasion, e.g., for crimping certain electrical connectors.

In a sales catalog entitled "Rema Press-Technik" of the German firm of Rema Lipprandt GmbH & Co KG, Bonn, are shown compression tongues of the vice type which have no shank members and in which the die members are mounted in a yoke member so as to be rotatable relative to the handles about an axis extending in the tool plane.

The tool enables application of a high thrust on the work piece, and the work piece may be introduced into the tool from any arbitrary lateral direction, but not frontally.

OBJECT OF THE INVENTION

It is an object of the present invention to provide pliers enabling optionally frontal or lateral feeding, not occupying more space than conventional pliers of comparable size, and in which the work piece may be affected with the same high thrust as in conventional pliers of comparable size.

Thus the user may select the manner of working which appears to him most suitable for a given task (be it connector crimping) without the need to procure, and possibly to carry to an outward job, two different pairs of pliers.

SUMMARY OF THE INVENTION

This object, and others which will become apparent hereinafter, are attained with pliers for lateral and frontal introduction of work pieces to be treated in a pair of dies, which comprise in combination:

- a pair of handles extending in a tool plane;
- a pair of shank members operatively connected to said handles for moving one relative another between a position of maximum spacement and a position of minimum spacement, each shank member having a free end and an inner side turned toward the other shank member;
- a pair of co-operating die members, each die member being in the region of the said free end attached to the inner side of one of the shank members so as to be rotatable about an axis situated in the tool plane;
- a follower means for ensuring corresponding rotation of both die members without impeding their relative movement, and comprising two co-operating parts, each one located on one of the die members, so that the die pair may be turned into a selected rotational position, inclusive of the position for introducing the work piece frontally from the said free ends, and the position for introducing the work piece laterally.

In pliers of the scissors-type, where each die member is pivotable about a pivot axis extending at right angles to the tool plane, a truing-up means ensures parallelity of the two die members during their pivotal movement. Said truing means may be embodied by the follower means, which thus fills a double function.

BRIEF DESCRIPTION OF THE DRAWINGS

The above and other objects will be better understood from the following, reference being made to the accompanying drawing, in which.

DETAILED DESCRIPTION OF THE INVENTION

Figure 1A:
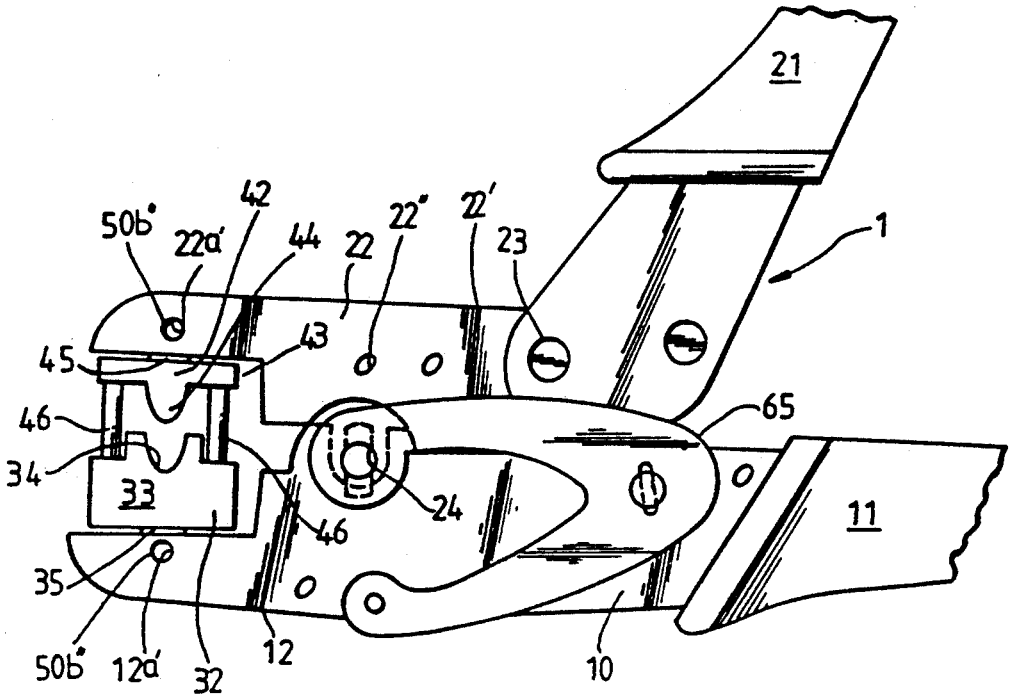
FIG. 1A is a lateral view of the pliers according to the invention in condition for lateral introduction of the work piece.
Figure 1B:
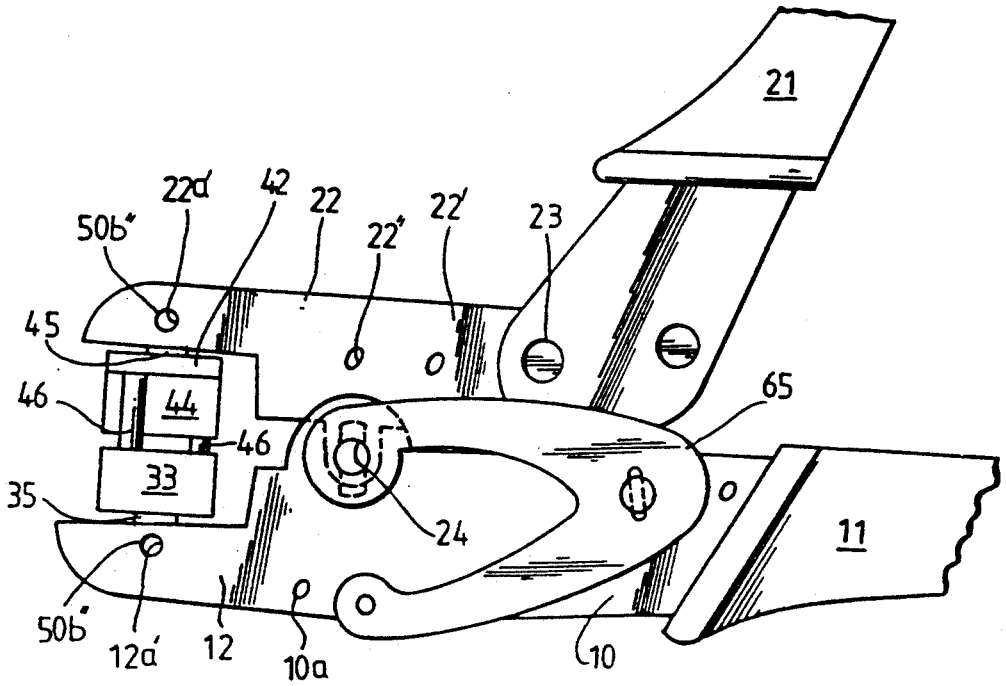
FIG. 1B is a lateral view of the pliers of FIG. 1A in condition for frontal introduction of the work piece.

The pliers 1 of FIG. 1 are provided with two shank members 12, 22 and two handles 11, 21. The shank member 12 and the handle 11 are united into a rigid tool body 10. The handle 21 is by means of a pivot pin 23 pivotally attached to the shank member 22, more precisely to a rear extension 22' thereof. The two handles 11, 21 and the two shank members 12, 22 lie in a tool plane defined by the drawing plane of FIG. 1.

The shank member 22 is pivotally attached to the tool body 10 by a pivot pin 24 which with the aid of a stirrup 65 is resiliently mounted on the tool body 10. This manner of mounting lies outside the scope of the present invention. It will appreciated, however, that the two shank members 12, 22 are in conventional manner movable between a position of maximum mutual spacement, and a position of minimum mutual spacement.

Figure 2:
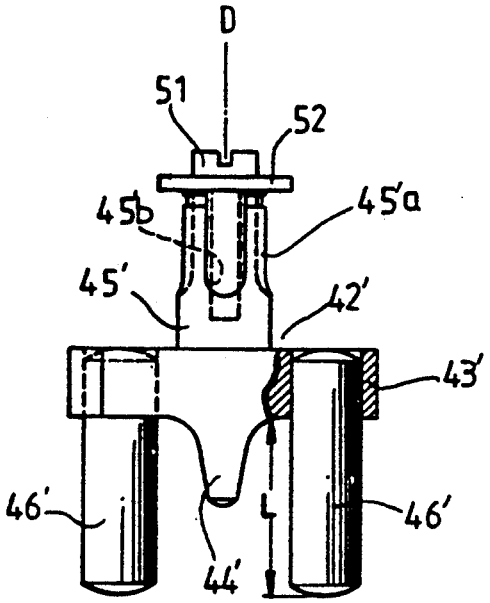
FIG. 2 shows at a larger scale a somewhat modified embodiment of the upper die member of FIG. 1.
Figure 3:
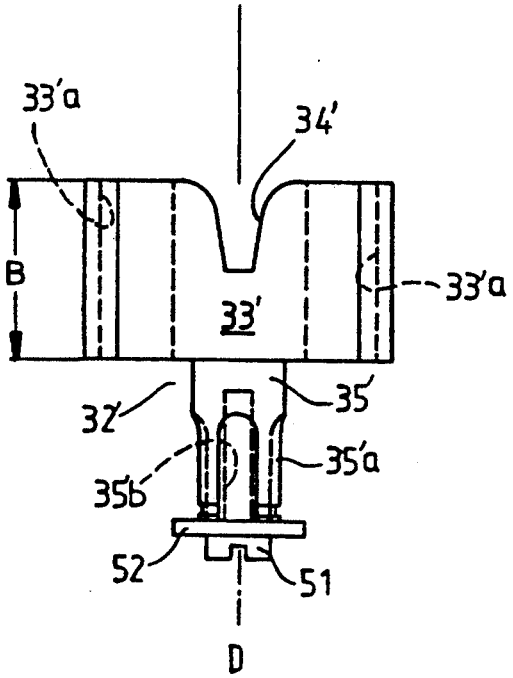
FIG. 3 shows at the same scale as FIG. 2 the corresponding lower die member.

According to the present invention, a lower die member 32 and an upper die member 42 are with the aid of rotational pins 35, 45 mounted on the inner sides of the shank members 12, 22 respectively in the region of their free ends for rotation about a common rotational axis D (FIGS. 2 and 3). The said inner sides are the sides or edges of one shank member which face the other shank member, while the denominations "upper" and "lower" are purely conventional for the convex and concave dies (as the whole pair of pliers may be turned up and down).

Figure 4:
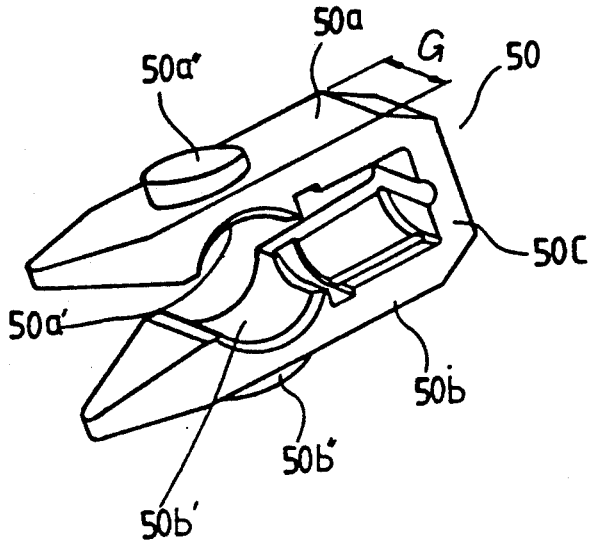
FIG. 4 shows in a perspective view at a still larger scale a holder-insert for the die members of FIGS. 2 and 3.
Figure 5:
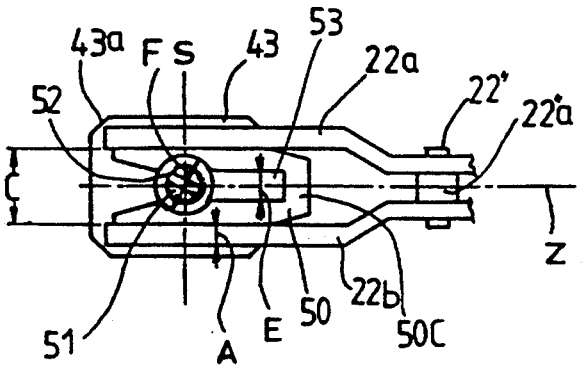
FIG. 5 is a plane view at the scale of FIG. 1 of the front part of the pliers of FIG. 1 with the holder-insert of FIG. 4.

The rotational pins 35, 45, embodying said axis D, are in their turn pivotally mounted in the shank members 12, 22 in a manner which will be explained more detail in connection with FIGS. 4 and 5, for pivotal movement about axes S (FIG. 5). The axes S extend at right angles to the tool plane.

The upper die member 42 has a substantially rectangular (FIG. 5) base plate 43, from one side of which (the lower one in the drawing) protrudes a convex die means 44. From the opposite side protrudes the said rotational pin 45 which provides the rotational mounting of the upper die member 42 in the shank member 22, and which as pin 45' is more clearly shown in FIG. 2.

The lower die member 32 has a base plate 33 with identical plane view shape as the base plate 43, and from one side of which (the upper one in the drawing) protrudes a concave die means 34 matching the convex die means 44. From the opposite side protrudes a rotational pin 35 which is identical with the rotational pin 45, provides the rotational mounting of the lower die member 32 in the shank member 12, and as pin 34' is more clearly shown in FIG. 3.

The upper and lower die members 32, 42 define together a die pair.

The upper die member 42' of FIG. 2 is provided with a somewhat modified convex die means 44' protruding from the lower face of the base plate 43', and with a rotational pin 45' which has an axial threaded bore 45'*b* and at least two, and preferably four depressions 45'*a* at the surface, the purpose of which will be explained later.

The lower die member 32' of FIG. 3 is on the upper side of the base plate 43' provided with a concave die means 34' matching with the convex die means 44' and from the opposite lower side protrudes a rotational pin 35' which is identical with the rotational pin 45' having an axial threaded bore 35'*b* and four depressions 35'*a* at its surface.

In the base plate 34 or 34' are further anchored two cylindrical guide rods 46 or 46' which with a free length L project on the same side as the convex die means 44 or 44'.

The base plate 43, 43' is considerably thicker than the base plate 33 or 33', and for the reception of the guide rods 46, 46' are there provided two openings 33' with a cross-sectional shape corresponding to that of the guide rods which may freely glide therein.

More precisely, the arrangement is such that the guide rods 46' protrude with a terminal part at their free end in the openings 33'*a* even when the two die members 32', 42' are at their maximum spacement. The length of the openings 33'*a* corresponds at least to the said maximum spacement plus the length of the said terminal part. The thickness B (FIG. 3) of the base plate 33' has obviously to be the same as the length of the openings 33'*a*, or it may be somewhat larger than the openings, if these openings are embodied by blind holes.

With these dimensions, the free ends of the guide rods 46' never can leave the openings 33'*a* and never can project from the obverse face of the base plate 33'. The latter circumstance could interfere with the free rotatability of the die member 32'.

The guide rods 46, 46' and their receiving openings 33'*a* define a follower means for ensuring corresponding rotation of both die members 32', 42' without impeding their to-and-fro movement. The follower means comprises two parts, viz. the rods 46' and the openings 33'*a* respectively, each of which is arranged on different die member.

All four corners of the rectangular base plates 33, 33', 43, 43' may be bevelled, as best seen in FIG. 5, and the two guide rods 46' and their receiving openings 33'*a* are preferably located in the region of two diametrically opposed corners. The follower means may also have a different construction, and may be embodied by a single rod and a single opening with non-circular cross-section.

The pliers 1, i.e., the tool body 10 as well as the shank member 22, are in a per se known manner built-up of two parallel side plates such as 22*a*, 22*b* in FIG. 5 which are held together by bolts such as 22" and spaced one from another by spacer sleeves such as 22"*a*, so that a void space Z is obtained between the side plates.

In a preferred embodiment of the invention, the rotational pins 35, 35', 45, 45' are accommodated in the void space Z in the front part of the two shank members 12, 22 with the aid of holder-inserts 50 according to FIG. 4, which preferably, but not necessarily, are made of plastics.

The holder-inserts 50 are substantially U-shaped with two leg parts 50*a*, 50*b* and a bridge part 50*c*. The legs are tapered at their free ends and are at their inner faces provided with opposite recesses 50*a*', 50*b*' which together define a cylindrical bearing means with a radius corresponding to the cross-sectional radius of the rotational pins 35, 35', 45, 45'.

The legs 50*a*, 50*b* are further at their outer faces, in the region where the recesses 50*a*', 50*b*' are located at the inner faces, provided with short, protruding axle stumps 50*a*'', 50*b*'' having a length in the order of magnitude of the thickness A (FIG. 5) of the side plates 22*a*, 22*b*. In the side plates 22*a*, 22*b* (and in the side plates of the shank member 12) are mounting openings 12*a*', 22*a*' provided for the said axle stumps 50*a*'', 50*b*''. These axle stumps embody the pivot axis S of the respective die member 32, 42.

It will be realized that the above mentioned follower means 33'*a*, 46', ensuring invariable mutual rotational position (about the axes D) of the two die members, at the same time ensures their mutually parallel position. The follower means defines thus also a truing-up means for ensuring constant parallelity of the two die members under their pivotal movements. In principle, however, even separate following and truing-up means are conceivable.

The assembly of the tool may proceed as follows. The axle stumps 50*a*'', 50*b*'' of the holder-inserts 50 are inserted into the mounting openings 12*a*', 22*a*' in the side plates 22*a*, 22*b* by slightly compressing the leg parts 50*a*, 50*b*. Inserts made of non-resilient material, such as metal, not allowing compression, are inserted before the side plates are affixed to one another. Thereupon are the rotational pins 35, 35', 45, 45', which embody the rotational axes D of the two die members 32, 42, introduced into the recesses 50*a*', 50*b*'.

The rotational pins 35 etc. are as long as the legs 50*a*, 50*b* are broad (breadth G, FIG. 4), and washers 52 are affixed to their free ends by means of screws screwed-in into the threaded axial openings 35'*b*, 45'*b*. The diameter F of the washers 52 is smaller than the spacement C of the inner faces of the two side plates 22*a*, 22*b*, and larger than the diameter of the cylindrical bearing means defined by the two recess 50'*a*, 50'*b*. The die members 32, 42 are thus secured in their respective holder-inserts 50.

In the space between the two leg parts 50*a*, 50*b*, the bridge part 50*c*, and the rotational pin 35 etc. in the holder-in-sert 50 is an engagement means 53 of the drop-in-pin-type provided for temporarily locking the die members in a selected rotational position.

The said means comprises a resiliently mounted element such as a spring-loaded ball etc. for engagement with any of the depressions 35'*a*, 45'*a* on the rotational pin 35 etc. Consequently, the die pair 32, 42; 43', 42' may be in arbitrary direction (clockwise or counter-clockwise) transferred from the position of FIG. 1A for lateral feed into the position of FIG. 1B for frontal feed of a work piece (and, without locking, also in any intermediate position).

As co-rotation of the two die members 32, 42 about the axis D is ensured by the follower means, the said engagement means 35'*a*, 53, and particularly the part 53 thereof, may be provided only at one of the two die members.

An engagement means may also be arranged in some other location, e.g. on adjacent faces of the shank and die members, or it may be omitted altogether.

It will be appreciated that when the present invention is applied to pliers with a parallel movement of the shank members, the die members 32 etc. need not be pivotable about the axes S, and thus can be mounted in the respective shank members only for rotation about the axis D. A follower means such as 33'*a*, 46' will, however, still be needed to ensure co-rotation of the two die members.

The die members may also, in a known manner, comprise several die means, i.e. several die pairs for work pieces of different sizes may be provided on the two die members.

The invention is of course also applicable to pliers where both shank members are rigidly connected to the respective handle, or where both shank members are pivotally connected to the respective handle.

What is claimed is:

1. Pliers for lateral and frontal introduction of work pieces for treatment in a pair of dies, said pliers comprising:

a tool body elongated along a longitudinal axis;

a pair of handles movable relative to one another in a tool plane, said tool plane containing said longitudinal axis;

a pair of shank members operatively connected to said handles and operatively connected to one another for relative movement between a position of maximum spacement and a position of minimum spacement, each shank member having a free end and an inner side turned toward the other shank member;

a pair of co-operating die members having front and rear sides, each die member being in a region of the said free end of respective ones of said shank members and attached to the inner side of its corresponding shank member so as to be rotatable about an axis lying in the tool plane transverse to the longitudinal axis of the tool body; and a follower means for ensuring corresponding rotation of both die members without impeding their relative movement, and comprising two co-operating parts, each one located on one of the die members; wherein said pliers are adapted to be manually driven; and the die pair may be turned into a selected rotational position, inclusive of the position for introducing the work piece frontally from the said free ends, and the position for introducing the work piece laterally.

2. The pliers of claim 1, wherein the follower means comprises at least one guide rod associated to one of the die members, and, in the other die member, one opening for the accommodation of each guide rod, the guide rod protruding with a terminal part of its free length into the said opening even at the maximum spacement of the two die members.

3. The pliers of claim 2, wherein the length of the said opening corresponds at least to the said maximum spacement plus the length of the said terminal part, and one of the die members has a base plate with a thickness sufficient for said opening.

4. The pliers of claim 1, wherein the shank members perform a scissors-like movement and each die member is pivotable about an axis extending at right angles to the tool plane, a truing-up means being provided to ensure parallelity of the two die members during said pivotal movement.

5. The pliers of claim 4, wherein the said follower means define also the truing-up means.

6. The pliers of claim 4, wherein:

each of said shank members comprises two parallely spaced side plates; and said pliers further comprise two rotational pins each projecting from the rear side of a die member and extending into a void space between the two side plates of the corresponding shank member for rotatable affixation to the shank member.

7. The pliers of claim 6, comprising U-shaped holder-inserts with two leg parts connected by a bridge part and having inner and outer faces, recesses shaped so as to form parts of a cylindrical bearing means being provided in the said inner faces for accommodating the rotational pin, and axle stumps projecting from the said outer faces in the regions of the recesses at the inner faces for being rotatably inserted in openings provided to the purpose in the side plates.

8. The pliers of claim 7, wherein each rotational pin is provided with a threaded axial boring, and a washer having a diameter larger than the diameter of the cylindrical bearing means and smaller than the spacement of the inner faces of the side plates is secured to the free end of the rotational pin by a screw screwed-in in the threaded opening.

9. The pliers of claim 1, comprising an engagement means for temporarily locking the die members in a selected rotational position.

10. The pliers of claim 9, wherein each die member is at its rear side provided with a projecting rotational pin and the said engagement means comprises at least two depressions on its surface for engagement with a resiliently mounted element.

11. The pliers of claim 9, wherein each die member has a projecting rotational pin at its rear side and said engagement means comprises at least two depressions on the surface of said die member for engagement with a resiliently mounted element.

12. Pliers for multi-directional introduction of workpieces comprising:

first and second force-applying elements, said force-applying elements being operatively connected together and parallel to a longitudinal axis of said pliers; and first and second die members, each disposed on a first end of corresponding ones of said first and second force-applying elements to rotate about an axis substantially perpendicular to said longitudinal axis;

wherein said die members may be selectively rotated to accommodate introduction of said workpieces from a plurality of directions;

wherein each of said force-applying members comprises:

a handle adapted for receiving manual force to apply to said workpieces; and a shank member for applying said force to said workpieces;

wherein each of said handles is operatively connected to its respective shank member;

said shank members are operatively connected together; and said die members are disposed on respective ones of said shank members;

wherein said shank members are disposed to perform a scissors-like movement; and each of said die members is pivotable about an axis extending at right angles to said tool plane; and said pliers further comprise alignment means for maintaining relative alignment of said die members during said scissors-like movement.

13. The pliers of claim 12, wherein:

each of said shank members comprises two parallely spaced side plates; and said pliers further comprise two rotational pins each projecting from the rear side of a die member and extending into a void space between the two side plates of the corresponding shank member for rotatable affixation to the shank member.

14. The pliers of claim 13, further comprising:

two U-shaped holder inserts, each of said holder inserts having two leg parts connected by a bridge part, inner and outer faces, recesses shaped to accommodate said rotational pin, and axle stumps projecting from the outer faces in the regions of the recesses at the inner faces rotatably inserted in corresponding openings in the side plates.

15. The pliers of claim 14, wherein:

said rotational pin comprises a threaded axial boring; and a washer having a larger diameter than said recesses and a smaller diameter than the spacement of the side plate inner faces is disposed on the free end of each rotational pin by a screw disposed in said threaded opening.

16. The pliers of claim 12 further comprising engagement means for temporarily locking said die members in a selected rotational position.

* * * * *